United States Patent [19]

Hallock

[11] 4,034,304

[45] July 5, 1977

[54] METHOD AND APPARATUS FOR GENERATING A NON-LINEAR SIGNAL

[75] Inventor: David B. Hallock, Marion, Iowa

[73] Assignee: Rockwell International Corporation, El Segundo, Calif.

[22] Filed: June 8, 1976

[21] Appl. No.: 694,009

[52] U.S. Cl. ..... 328/142; 328/160; 307/229

[51] Int. Cl.[2] ..... G06G 7/12

[58] Field of Search ..... 307/229, 230; 328/142, 328/160, 143, 144

[56] References Cited

UNITED STATES PATENTS

| | | | |
|---|---|---|---|
| 3,537,014 | 10/1970 | Speth | 328/142 |
| 3,550,220 | 12/1970 | Gill et al. | 328/142 |
| 3,757,234 | 9/1973 | Ohlson | 328/142 |
| 3,859,603 | 1/1975 | Herzneg | 328/160 |

*Primary Examiner*—Stanley D. Miller, Jr.
*Assistant Examiner*—B. P. Davis
*Attorney, Agent, or Firm*—Howard R. Greenberg; Robert J. Crawford

[57] ABSTRACT

A non-linear output signal is generated from an input signal by multiplying the input signal with a feedback signal which is directly proportional to the difference between the output signal and some signal threshold level whenever the output signal is in one region with respect to the signal threshold level and zero whenever the output signal is in the other region.

9 Claims, 3 Drawing Figures

$$V_F = \sum_{T=1}^{T=N} K_{LT}(V_O-V_{LT}) + \sum_{T=1}^{T'=N'} K_{UT'}(V_O-V_{UT'})$$

$$V_F = \sum_{T=1}^{T=N} K_{LT}(V_O - V_{LT}) + \sum_{T'=1}^{T'=N'} K_{UT'}(V_O - V_{UT'})$$

METHOD AND APPARATUS FOR GENERATING A NON-LINEAR SIGNAL

BACKGROUND OF THE INVENTION

The subject invention pertains generally to non-linear varying electrical signals and specifically to a technique for generating same.

Quite often, in performing control functions with electrical signals, it is desired or necessary to afford an output function which is not linearly related to the input signal. For example, where varactors are used to tune radio receivers, the capacitance does not normally vary linearly as a function of frequency (in order to optimize performance) thus necessitating a non-linear control signal. Although the non-linear control signal could be generated directly from the mechanism performing the control function (such as the frequency tuning knob in the case of a radio receiver) it may be more expeditious to first develop a linear signal therefrom and then to convert that signal to a non-linear signal for implementing the non-linear control function relationship.

Although there are a number of techniques for developing an output signal which is a non-linear function of an input signal, they normally exhibit various disadvantages. For example, one electromechanical technique which entails driving a non-linear potentiometer from a linear potentiometer requires precise components and introduces mechanical inertia delays which detract from the response time. Another more prominent technique employs the well known linear-piecemeal approximation approach utilizing diode wave shaping to generate straightline sections which are superposed together to simulate the non-linear curve relating the output to the input. The major disadvantage with this approach is of course the difficulty in achieving smooth transitions between adjacent segments as well as simulating the natural curvature with straightline sections so as to effecaciously reproduce the continuously smooth non-linear curve.

With the foregoing in mind, it is a primary object of the present invention to provide a new and improved technique for generating an output signal which is a non-linear function of an input signal.

It is a further object of the present invention to provide such a technique which effectuates the non-linear curve simulation more efficaciously than heretofore.

It is still a further object of the present invention to provide such a new and improved technique which affords great design flexibility, yet is easily implemented.

The foregoing objects as well as others and the means by which they are achieved may best be appreciated by referring to the Detailed Description of the Preferred Embodiment which follows hereinafter together with the attached drawings.

BRIEF DESCRIPTION OF THE INVENTION

In accordance with the stated objects, the present invention generates an output signal which is a non-linear function of an input signal by multiplying the input signal with a feedback signal which is directly proportional to the difference between the output signal and a signal threshold level whenever the output signal is in one region with respect to the threshold level and zero whenever the output signal is in the other region. By judiciously selecting an appropriate gain factor in the feedback path to achieve the direct proportionality, the output signal can be made to follow the curvature of the non-linear waveform as closely as practicable. To afford design flexibility for simulating curves as closely as desired, a plurality of feedback signals may be generated and added together in superposition fashion before being multiplied with the input signal to generate the non-linear output signal, with each feedback signal having its own individual signal theshold level. By judiciously selecting the number of feedback signals and their respective threshold levels and associated gain factors, any desired non-linear curve can be simulated.

DETAILED DESCRIPTION OF THE PREFERRED EMBODIMENT

Figure 1:
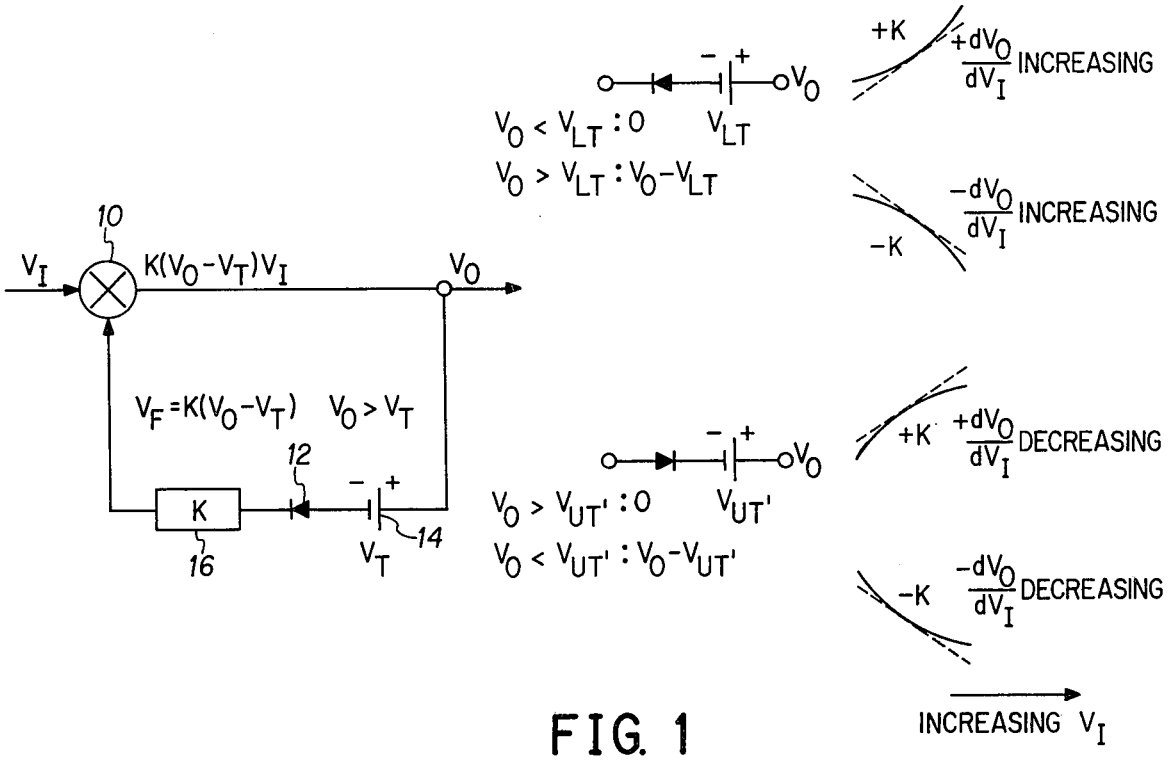
FIG. 1 is a simple block diagram expositive of the inventive principle.

As shown in FIG. 1, $V_O$ represents an output voltage signal which it is desired to be a non-linear function of an input voltage signal $V_I$ and which is generated at the output of a multiplier circuit 10 which receives the input signal $V_I$ and multiplies it with a signal $V_F$. $V_F$ is a feedback signal that is developed by applying the output signal $V_O$ to a threshold circuit such as comprised by diode 12 in series with a reverse biasing DC source 14 and a gain circuit 16 which multiplies the output of diode 12 by a gain factor K. It is readily apparent that when $V_O$ is less than $V_T$, the voltage of DC source 14, the feedback signal $V_F$ developed at the output of the gain circuit 16 is zero since the diode 12 output signal is zero and when $V_O$ exceeds $V_T$, then $V_F = K(V_O - V_T)$. It is assumed that the voltage drop across the diode 12 when conducting is zero, its standoff voltage being subtracted from the voltage $V_T$ to determine at what voltage $V_O$ conductance should begin. It should be noted that the diode 12 and DC source 14 are only exemplary, since any threshold circuit, such as a zener diode, could be used to establish the desired signal threshold level to separate the conducting and non-conducting regions.

With $V_O$ less than $V_T$ and diode 12 non-conducting, the product of $V_I$ and $V_F$ at the output of multiplier 10 is of course zero. When $V_O$ exceeds $V_T$ and diode 12 does conduct, $V_F$ is no longer zero, but equal to $K(V_O - V_T)$ which is directly proportional to the difference between the output signal $V_O$ and the signal threshold level established by $V_T$. Consequently, with the output signal $V_O$ in the region above the signal threshold level $V_T$, the output of multiplier circuit 10 is equal to $K(V_O - V_T)V_I$. Solving for $V_O$, it is seen that the output signal $$V_O = \frac{K\,V_T \cdot V_I}{K(V_I - 1)}.$$

It will be readily seen that $V_O$ is a non-linear function of $V_I$ and that the resultant curve has a positive slope $$\left(+\frac{dV_O}{dV_I}\right)$$

which increases with increasing $V_I$ at a rate which is determined by the gain factor K. Thus, the non-linear natural curvature to be simulated can be set by judiciously selecting the gain value K.

The foregoing is illustrated by the first curve at the top of FIG. 1 wherein the diode 12 is poled as shown in the block diagram and gain circuit 16 provides a +K gain factor so that the simulated curve slopes upward more rapidly $$\left(+\frac{dV_O}{dV_I}\text{ increasing}\right)$$

as $V_I$ increases. If it were desired to generate a curve which bent downward more rapidly $$\left(-\frac{dV_O}{dV_I}\text{ increasing}\right)$$

with increasing $V_I$, then one would merely employ a negative gain factor −K as shown by the second curve in FIG. 1. It will be further seen that by reversing the connection of the diode 12 in the block diagram of FIG. 1, an upper threshold level $V_{UT}$ (vis-a-vis the foregoing lower thresholv level $V_{LT}$) can be established to reverse the conducting and non-conducting regions so as to provide a feedback signal $V_F$ which is zero when $V_O$ is greater than $V_{UT}$ and is directly proportional to the difference between $V_O$ and $V_{UT}$ when $V_O$ is less than $V_{UT}$. In this case, a positive gain factor +K produces a curve which slopes upward $$\left(+\frac{dV_O}{dV_I}\right)$$

at a decreasing rate with increasing $V_I$ while a negative gain factor −K produces a curve which has a downward slope $$\left(-\frac{dV_O}{dV_I}\right)$$

which decreases with increasing $V_I$. Thus, by properly poling the diode 12 and selecting the proper polarity for the gain factor K, any type curve can be simulated.

Figure 2:
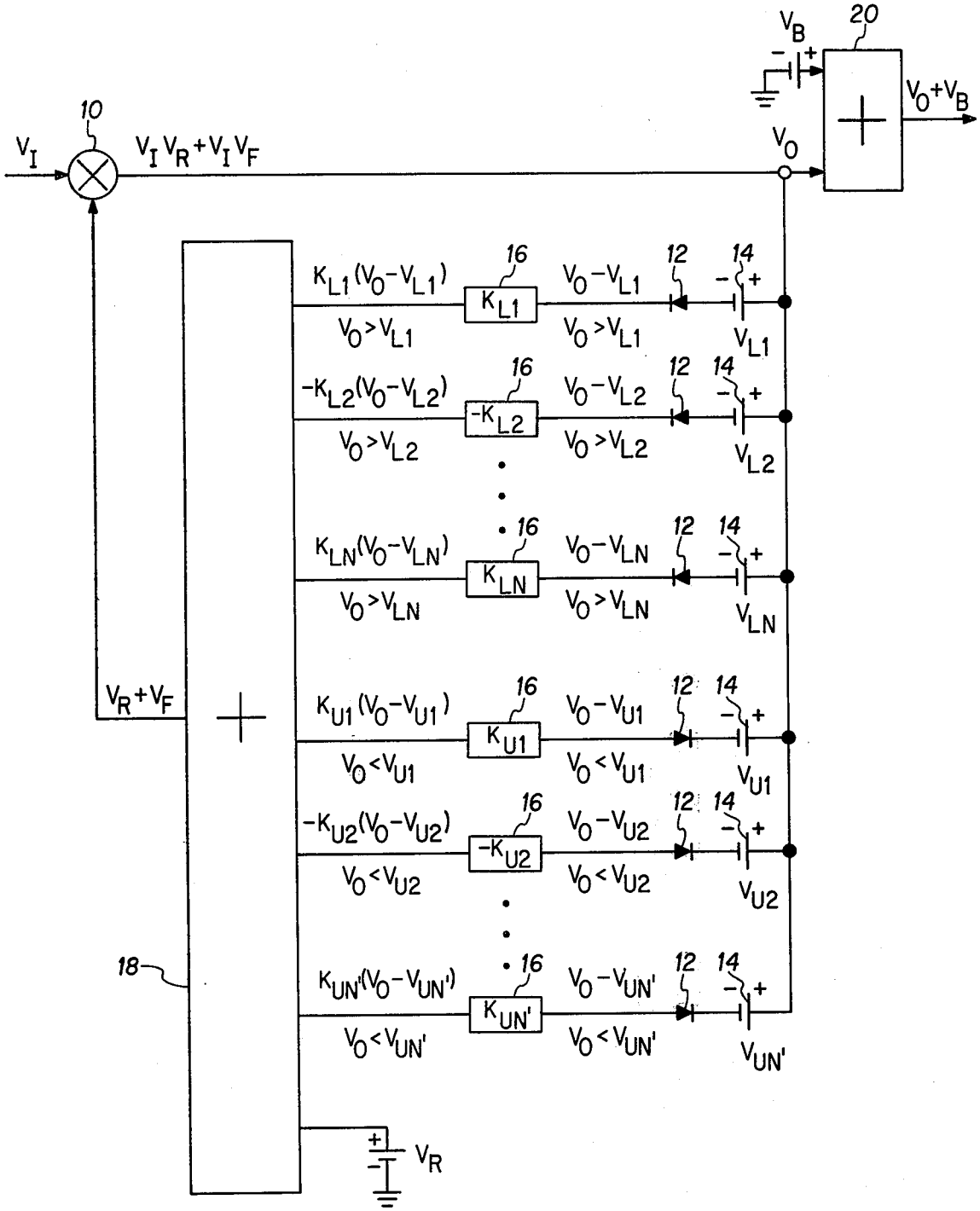
FIG. 2 is a block diagram depicting the invention for achieving maximum design flexibility to simulate any desired non-linear function.

Although the circuit of FIG. 1 permits a non-linear function having a single continuous curvature to be simulated, the use of one feedback signal provides no design flexibility for simulating varying curves. Such design flexibility is afforded by the circuit of FIG. 2 (like elements being designated the same as in FIG. 1) which employs a plurality of feedback signals that are added together in superposition fashion before multiplication with the input signal to generate the desired non-linear output signal. Each feedback signal is developed through its own associated diode 12 and individual DC source 14 for establishing its own individual signal threshold level and its individual circuit 16. The individual feedback signals are linearly added together by an adder 18 to produce a composite feedback signal $V_F$ which is equal to:

$$\sum_{T=1}^{T=N} K_{LT}(V_O - V_{LT}) + \sum_{T'=1}^{T'=N'} K_{UT'}(V_O - V_{UT'})$$

where T and T′ represent respectively new lower and upper threshold levels at which some feedback signal is desired to superpose on already existing feedback signals and N and N′ represent respectively the number of lower and upper threshold levels to be employed, Then:

$$V_O = V_I \sum_{T=1}^{T=N} K_{LT}(V_O - V_{LT}) + V_I \sum_{T=1}^{T'=N'} K_{UT'}(V_O - V_{UT'}).$$

Knowing the desired non-linear relationship between the output and the input signals, one may judiciously select the number and magnitude of threshold levels and the gain factors K respectively associated therewith through well known mathematical techniques (which may be precise when the number of threshold levels are few, but may require trial and error approaches such as computer numerical optimization when the number of threshold levels are great) to simulate the non-linear curve as closely as desired without the need for straightline segments such as used in linear piecemeal approximations. If it is desired to superpose a ramp function in generating the non-linear output signal $V_O$, then a fixed reference voltage $V_R$ may be applied directly to the adder 18. Another adder 20 may be employed to combine the non-linear output signal $V_O$ with a fixed base $V_B$ if desired. Although shown outside the feedback loop, it is to be understood that it could just as easily be included in the loop, if desired, the value $V_B$ being taken into account in the setting of the signal threshold level.

Figure 3:
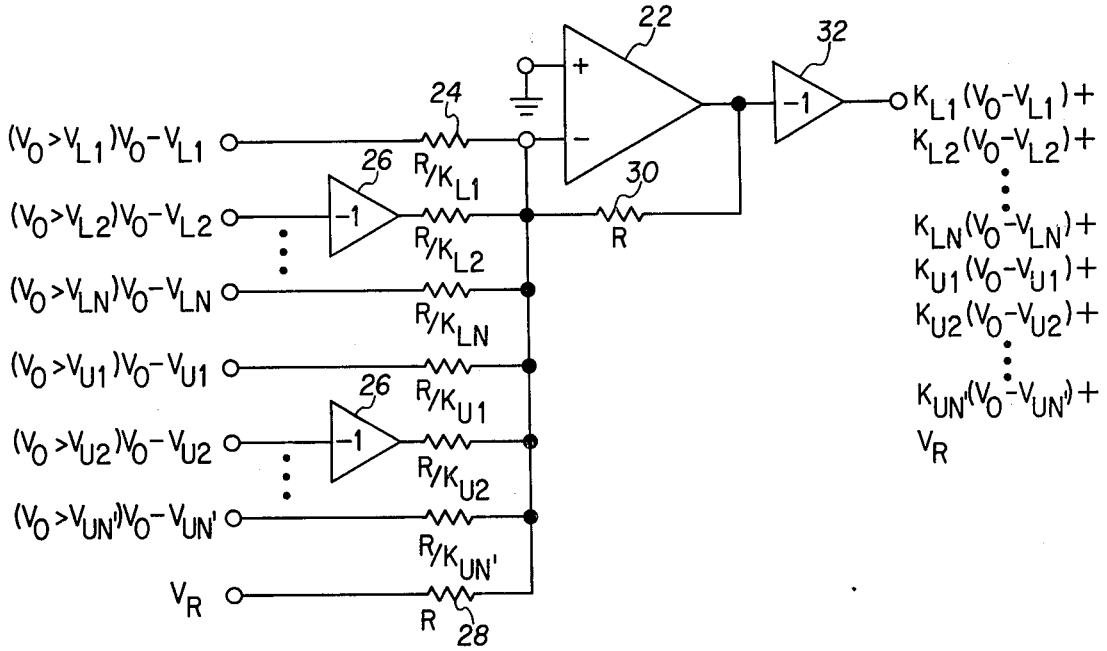
FIG. 3 is a schematic diagram depicting the preferred manner for developing the individual feedback signal gain factors as well as summing the feedback signals before multiplying them with the input signal.

Although each gain circuit 16 might be merely an amplifier with positive or negative gain, depending upon the sign of K, and the adder 18 might be a summing operational amplifier, they may be combined into a simpler and more economical circuit as shown in FIG. 3 wherein summing operational amplifier 22 provides at its output the negative sum of all the signals applied to its summing inverting (−) input. Each individual diode 12 output is applied to the inverting input of operational amplifier 22 through a resistor 24 having a value R divided by its associated gain factor K, with negative gain factors being generated by first passing the signal through an inverter 26. The ramp generating voltage $V_R$ is applied to the inverting input of operational amplifier 22 through a resistor 28 having a value R. By interconnecting the inverting input and output terminals of operational amplifier 22 with a feedback resistor 30 having a value R, the operational amplifier 22 produces at its output the negative sum of all the diode 12 outputs multiplied by their respective gain factors K. Passing this output through an inverter 32 produces a desired positive sum (as indicated in FIG. 3 for $V_O$ values in conductive regions) which may then be applied to the multiplier circuit 10 for multiplication with the input signal $V_I$. The multiplier circuit 10 may be realized through any one of well known circuits, for example such as shown at page AN20-8 of Linear Applications, Volume 1, published by National Semiconductor Corporation.

Thus, as the foregoing demonstrates, the invention affords a simple design, albeit one having great flexibility for generating an output signal which is a non-linear function of an input signal so as to efficaciously simulate any desired curve shape. Since modifications to the preferred embodiment may be made by those skilled in the art without necessarily departing from the scope and spirit of the invention, the foregoing is intended to be exemplary and not circumscriptive of the invention as it will now be claimed hereinbelow.

What is claimed is:

1. Apparatus for generating an output signal which is a non-linear function of an input signal, comprising:

multiplier circuit means for receiving the input signal and multiplying it by a feedback signal applied thereto to provide the non-linear ouput signal;

threshold circuit means for establishing a signal threshold level to provide a signal at its output which is equal to the difference between the non-linear output signal from said multiplier circuit means and said signal threshold level whenever the non-linear output signal is in one region with respect to said signal threshold level and zero whenever the non-linear output signal is in the other region, and feedback circuit means for generating and applying to said multiplier circuit means said feedback signal as a direct function of the signal output of said threshold circuit means.

2. The apparatus of claim 1 wherein said feedback circuit means includes a gain circuit for multiplying the input signal thereto by a constant factor to generate a feedback signal directly proportional thereto.

3. The apparatus of claim 1 wherein said threshold circuit means comprises a plurality of threshold circuits, each for establishing a different signal threshold level, and said feedback circuit means includes a plurality of gain circuits, one for each threshold circuit for multiplying its output by a gain factor to generate a signal directly proportional thereto and adder circuit means for providing at its output the sum of the outputs of said gain circuits.

4. The apparatus of claim 3 wherein said feedback circuit means comprises a summing operational amplifier and each of said plurality of gain circuits comprises a resistor through which the output of its associated threshold circuit is applied to the summing input of said amplifier.

5. The apparatus of claim 3 including additional adder circuit means for establishing a fixed base signal.

6. The apparatus of claim 3 wherein the input and output signals $V_I$ and $V_O$, respectively, are related in a predetermined manner and $$V_O = V_I \sum_{T=1}^{T=N} K_{LT}(V_O - V_{LT}) + V_I \sum_{T'=1}^{T'=N'} K_{UT'}(V_O - V_{UT'}),$$

where $V_{LT}$ is the lower signal threshold level associated with level T out of N such levels and $K_{LT}$ represents the associated gain factor and $V_{UT'}$ is an upper signal threshold level associated with level T' out of N' such levels and $K_{UT'}$ represents the associated gain factor.

7. A method for generating an output signal which is a non-linear function of an input signal, comprising:

multiplying the input signal by a feedback signal to produce the non-linear output signal;

establishing a signal threshold level to provide a second signal which is equal to the difference between the output signal and said signal threshold level whenever the output signal is in one region with respect to said signal threshold level and zero when the output signal is in the other region, and generating said feedback signal by multiplying the second signal by a constant gain factor.

8. The method of claim 7 including establishing a plurality of signal threshold levels and a plurality of muliplying gain factors, one for each threshold level and summing up the second signals before multiplying with the input signal.

9. The method of claim 8 wherein the input and output signals $V_I$ and $V_O$, respectively, are related in a predetermined manner and $$V_O = V_I \sum_{T=1}^{T=N} K_{LT}(V_O - V_{LT}) + V_I \sum_{T'=1'}^{T=N'} K_{UT'}(V_O - V_{UT'}),$$

where $V_{LT}$ is the lower signal threshold level associated with level T out of N such levels and $K_{LT}$ represents the associated gain factor and $V_{UT'}$ is an upper signal threshold level associated with level T' out of N' such levels and $K_{UT'}$ represents the associated gain factor.

* * * * *